US006141646A

United States Patent [19]

Winterer et al.

[11] Patent Number: 6,141,646

[45] Date of Patent: Oct. 31, 2000

[54] DIGITAL SOUND PROCESSOR FOR PROCESSING MULTIPLE STANDARD SOUND SIGNALS AND CAPABLE OF GENERATING ADDITIONAL AUDIO SIGNALS

[75] Inventors: Martin Winterer; Miodrag Temerinac, both of Gundelfingen, Germany

[73] Assignee: Micronas Intermetall GmbH, Germany

[21] Appl. No.: 09/061,465

[22] Filed: Apr. 16, 1998

[30] Foreign Application Priority Data

Apr. 19, 1997 [EP] European Pat. Off. ..... 97106519

[51] Int. Cl.[7] ..... G10K 15/04

[52] U.S. Cl. ..... 704/503; 704/270

[58] Field of Search ..... 704/270, 500, 704/503

[56] References Cited

U.S. PATENT DOCUMENTS

| | | | |
|---|---|---|---|
| 5,524,051 | 6/1996 | Ryan | 380/9 |
| 5,592,588 | 1/1997 | Reekes et al. | 704/278 |
| 5,659,663 | 8/1997 | Lin | 704/258 |

FOREIGN PATENT DOCUMENTS

| | | | |
|---|---|---|---|
| 0756258 | 7/1995 | European Pat. Off. | G08G 1/09 |
| 0725504 | 12/1995 | European Pat. Off. | H04H 1/00 |
| 19513005 | 3/1995 | Germany | H04H 1/00 |

OTHER PUBLICATIONS

Derwent Information Ltd, English Abstract of European patent publication EP 0 725 504 A2 by Stefan Goss, Aug. 1996.

Derwent Information Ltd, English Abstract of German patent publication DE 195 13 005 A1 by Michael Six, et al., Sep. 1996.

Derwent Information Ltd, English Abstract of French patent publication FR 2 566 944 by Bronislav Vesnic., Jun. 1984.

Preliminary Data Sheet MSP 3410D Multistandard Sound Processor, Micronas Intermetall Edition Jan. 15, 1998—Order No. 6251–422–3PD.

Copy of European Search Report for 97106519.8, dated Sep. 30, 1997.

*Primary Examiner*—David R. Hudspeth
*Assistant Examiner*—Tālivaldis Ivars Šmits
*Attorney, Agent, or Firm*—Arthur L. Plevy; Buchanan Ingersoll PC

[57] ABSTRACT

A digital sound processor for processing multiple standard sound signals and including an audio source which is connected to a digital control input of the sound processor and generates, via externally or internally applied control signals, an audible signal or an audible signal sequence which is fed via the output devices of the sound processor to reproducers.

20 Claims, 1 Drawing Sheet

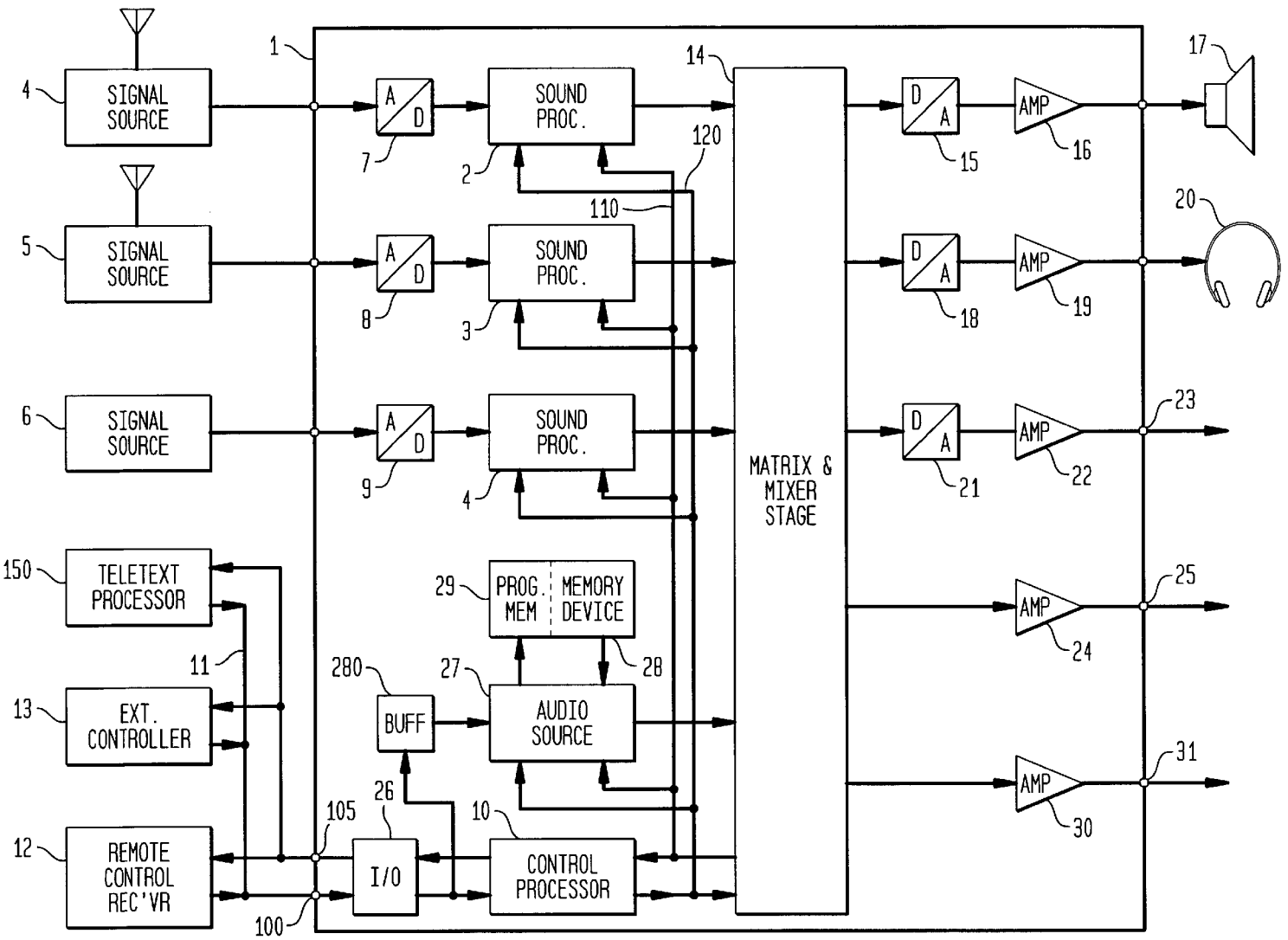
SIGNAL SOURCE
SIGNAL SOURCE
SIGNAL SOURCE
TELETEXT PROCESSOR
EXT. CONTROLLER
REMOTE CONTROL REC'VR
A/D
SOUND PROC.
SOUND PROC.
SOUND PROC.
PROG. MEM
MEMORY DEVICE
AUDIO SOURCE
BUFF
CONTROL PROCESSOR
I/O
MATRIX & MIXER STAGE
D/A
AMP
1
2
3
4
5
6
7
8
9
10
11
12
13
14
15
16
17
18
19
20
21
22
23
24
25
26
27
28
29
30
31
100
105
110
120
150
280

DIGITAL SOUND PROCESSOR FOR PROCESSING MULTIPLE STANDARD SOUND SIGNALS AND CAPABLE OF GENERATING ADDITIONAL AUDIO SIGNALS

FIELD OF INVENTION

This invention relates to a digital sound processor for processing multistandard sound signals which are fed as analog or digital signals from at least one source to the sound processor at baseband or higher frequencies.

BACKGROUND OF INVENTION

Such sound processors are suitable for processing sound signals of various transmission standards for entertainment electronics, such as sound signals of different television standards, satellite receivers, video recorders, radios with traffic information message decoders, etc., but also sound signals which are generated by means of specific personal computer sound cards. Via control inputs, the processing in the digital sound processor is adapted to the respective transmission standard or sound source, and via internal processors, the desired sound impression (treble, bass, volume, stereo effect, etc.) is adjusted.

One example of such a digital sound processor is the MSP 3410D Multistandard Sound Processor of Micronas Intermetall, a commercially available module used in entertainment electronics equipment. A detailed description of this flexible sound processor can be found, for example, in the relevant data sheet, Edition Jan. 15, 1998, Order No. 6251-422-3PD.

Despite the many uses of this sound processor and other sound processors, it is desirable that these electronic modules should not only process externally applied sound signals but be capable of generating sound signals of various descriptions themselves.

SUMMARY OF THE INVENTION

A digital sound processor, for processing multi standard sound signals which are applied as analog or digital signals from at least one signal source to the sound processor at baseband or higher frequencies, and from which separate output signals are formed for sound reproducers, including: the digital sound processor having a control input coupled to at least one external control device which sends control signals to an internal control processor provided in the sound processor for controlling the operating mode of the sound processor, said operating mode being dependent on the respective sound standard; wherein the control input is further coupled to an internal audio source which, by means of the control signals applied at the control input, generates further audio signals which are fed to the sound reproducers or to further sound reproducers.

BRIEF DESCRIPTION OF DRAWINGS

FIG. 1 is a schematic block diagram of the sound processor according to the present invention.

DETAILED DESCRIPTION OF THE INVENTION

According to the invention, this object is attained by coupling the control input in the respective sound processor to an internal audio source which, by means of the signals applied at the control input, generates audio signals which are fed to the existing sound reproducers or to further sound reproducers.

It is an advantage for the invention that the internal audio source with the associated circuits, which essentially comprise memory devices, can be readily added to the monolithic integrated circuit of the digital sound processor, since existing functional units can be used, such as digital filters and tone control stages as well as digital-to-analog converters and amplifiers in the output section.

The generated audio signals are defined by a data sequence which is either applied in a suitable data format over the external control lines or read from an internal memory device. The stored information was loaded over the control lines into a random-access memory (RAM) at an earlier time or the information is permanently stored in a read-only memory (ROM). For short audio signals, the memory device may also be a buffer in the internal control unit which is commonly used to compensate for a difference in the rate of data flow when transferring data from the external control unit. This compensation for differences in data flow rates, the decoupling of the clock systems, and the digital protocol for detecting the ready-to-transmit and ready-to-receive states is also referred to as "handshake procedure" or "handshake protocol". With sequential storage, however, longer audio signals require very much storage space, so that synthesis techniques are more appropriate in which the audio signals are composed of individual stored audio components which are retrieved by means of a microprogram. As audio components, individual sound frequencies or signal frequencies, such as noise, are retrievable. Further information contained in the microprogram relates to the respective duration, amplitude, or envelope of these individual audio components.

Such synthesis techniques have been known for a long time. With a suitable design, even a speech synthesizer can be implemented in the digital sound processor by such techniques. This permits particularly interesting applications in conjunction with further functional units in the respective device or combination of devices. The individual control instructions or operating states may be assigned identification melodies or audible identification signals. By means of the speech synthesis, application-related cues or prompts can be released. For example, the decoded textual information of a teletext processor can be converted into speech. In conjunction with a personal computer, advantageous applications result for the synthesizer and/or the speech synthesizer, particularly for the acoustical support of a wide variety of software programs and computer games. It is even possible to make texts audible for the blind using an optical scanner.

The invention and further advantageous features thereof will become more apparent from the following description of an embodiment of the digital sound processor when taken in conjunction with the accompanying drawing, whose single figure is a schematic block diagram of the sound processor.

The digital sound processor 1 illustrated in the figure shows the essential internal and external functional units, which interact with each other. The electronic connections are shown only as simple lines with arrows to indicate the direction of signal flow. Whether analog or digital signals are transferred will become apparent from the description. If functional units are present several times, only one unit is shown to simplify the illustration; for example, only one external loudspeaker symbol is shown although at least two spatially separated loudspeaker systems and associated signal outputs must be present for stereo or stereo surround reproduction.

The digital sound processor 1 contains first, second, and third internal sound processors 2, 3, and 4, which are connected at their input ends to first, second, and third external signal sources 4, 5, and 6, respectively. The first signal source 4 corresponds to the input and frequency-conversion circuits of a television receiver, which deliver the complex television signal in analog form at baseband or at an intermediate-frequency value. This analog signal is digitized by means of a first analog-to-digital converter 7 and then fed to the first sound processor 2. It is also possible to feed the sound processor 2 with signals digitized previously.

The second signal source 5 represents a satellite receiver, for example, which already provides digital output signals or whose analog output signal is quantized and can be easily converted into a data stream for the second sound processor 3 by means of a simple analog-to-digital converter 8.

The third signal source 6 represents a video recorder, for example, whose analog output signal is digitized by means of an analog-to-digital converter 9 and feeds the third sound processor 4. All sound processors 2, 3, 4 are connected via internal control lines 110, 120 to an internal control processor 10 which controls the respective operating mode of the digital sound processor 1. The control processor 10 evaluates the information from the individual sound processors 2, 3, 4 as well as information fed to it over an external control bus 11 which is connected to associated input and/or output sockets 100, 105. Connected to this unidirectional or bidirectional control bus 11 are external control facilities, such as a remote-control receiver 12 in a television set or control devices 13 of a personal computer.

The digital sound processor 1 further includes a matrix and mixer stage 14, which is coupled at the input end to all of the sound processors 2, 3, 4 and at the output end, via digital-to-analog converters 15, 18, 21 and/or amplifiers, to outputs for various sound reproducers. For example, one output of the matrix and mixer stage 14 is connected via the digital-to-analog converter 15 and an amplifier 16 to a loudspeaker 17. Another output is coupled via the digital-to-analog converter 18 and an amplifier 19 to headphones 20, and a further output is connected via the digital-to-analog converter 21 and an amplifier 22 to a linear output socket 23 of the digital sound processor 1. Such sockets are, for example, sockets of standardized connectors (=SCART) for interconnecting television receivers and video recorders. A digital output socket 25 is connected to the matrix and mixer stage 14 via an amplifier 24. With the increasing use of digital processing, it is appropriate to deliver the signals in digital form by means of digital output sockets.

The functional units described so far correspond essentially to the functional units of the above-mentioned digital sound processor MSP 3410D. The invention consists in the fact that the internal control processor 10 is additionally coupled, directly or by means of its input/output circuit 26, to an internal audio source 27, which, like the sound processors 2, 3, 4 is connected at its output end to the matrix and mixer stage 14. By the matrix and mixer stage 14, the output signals of the audio source 27 can be switched to arbitrary signal outputs of the sound processor 1 or admixed to the existing signals, with the latter being reduced in level by the internal control processor 10 if necessary. If the sound processor 1 is used to process audio signals in a car radio, traffic information messages or audible identification or warning signals can thus be superimposed on the existing audio signals, no matter which of the signal sources 4, 5, 6, e.g., an audio cassette, is currently active. The essential difference from known methods is that the internal audio source 27 does not receive these signals directly or in coded form from one of the externally connected signal sources 4, 5, 6 but generates these signals itself on call. In the limiting case, a single instruction word on the control bus 11 will suffice to release an audible signal or even synthesized speech information. This, of course, generally requires a memory device 28 in which the digitized signal sequence is stored, the stored data being retrievable singly or in groups. If such a release instruction is detected by the internal audio source 27, this instruction will determine the start address of an address generator, for example, which then reads the stored signal sequence sequentially from the memory device 28. Another release instruction, which is assigned to another externally applied control signal, reads out another audio-signal sequence.

It should be noted again that the sequence of control operations commonly performed in response to the control signal in the digital sound processor 1 remains essentially unchanged if the control signal is recognized as such. As a rule, these control signals are programmable by the equipment manufacturer or are defined by the received transmission standard or correspond to standardized control instructions. Besides this normal sequence of control operations, the invention causes an additional function of these known control instructions, or it uses new control instructions which have no effect in conventional sound processors, because they are not recognized there. The sound processors according to the invention are therefore interchangeable for existing sound processors.

Simple tone or sound sequences can be loaded as a sequence of control instructions, whose beginning and end are indicated by the data format, via the control bus 11 and the input/output circuit 26 into the memory device 28 or a buffer 280. In this manner, sound sequences can be programmed in conjunction with a personal computer attached as an external controller 13. For the reproduction of these sound sequences, the relatively slow data rate on the control bus 11 must be increased by temporal compression of the data prior to the digital-to-analog conversion or adapted to a higher data rate by a temporal interpolation of the signal contents. The system clock frequency in the digital sound processor 1 is generally high enough, for example 18.4 MHZ, so that analog intermediate-frequency signals of 7 MHZ and higher can be readily processed. Applied digital audio signals, for example from a satellite receiver 5, lie in a much lower frequency range, namely at 32 kHz, 44 kHz, or 48 kHz, so that the system clock frequency is also high enough. The data rate on the control bus 11, for example 8 kHz, is very low compared to the system clock frequency. By compression or interpolation of the applied or stored data, the processing clock in the audio source 27 is adapted to the processing clock of the other sound processors 2, 3, 4; this makes it possible to mix all signals in the matrix and mixer stage 14.

If the internal audio source 27 operates as a synthesizer, it also accesses stored signals, which, as mentioned above, are referred to as audio or signal components, in the memory device 28. However, the individual memory addresses are not read sequentially but in a predetermined order. This order is stored as a microprogram in a microprogram memory 29, shown in the figure as a part of the memory device 28. The use of the microprogram allows the stored signal components to be used in a multiple manner, both in the respective signal to be synthesized and in different signals. A very interesting application of the speech synthesis is the conversion of at least the alphanumeric output signals of a teletext processor 150 or a PC screen display with textual information into speech signals.

Further examples of advantageous uses of the invention are: wavetable synthesis or transfer of wave files generated in personal computers; user prompting via synthesized speech output, particularly in conjunction with computer applications; speaking-clock announcements; appointment and wake-up functions, with an enhancement of the effect being possible by speech synthesis; warning messages if a critical condition or a critical external event is to be indicated. The internal audio source 27 may also generate specific control signals which are transferred via the amplifier 30 to associated outputs 31. There, they can serve as drive signals for a multisegment display, for example. Thus, instead of the signals to be reproduced acoustically, arbitrary control signals or control-signal sequences can be retrieved from the memory device 28 by means of the audio source 27. This brief enumeration shows that the invention can be used to advantage in many ways.

Although the invention has been described in a preferred form with a certain degree of particularity, it is understood that the present disclosure of the preferred form has been made only by way of example, and that numerous changes in the details of construction and combination and arrangement of parts may be made without departing from the spirit and scope of the invention as hereinafter claimed. It is intended that the patent shall cover by suitable expression in the appended claims, whatever features of patentable novelty exist in the invention disclosed.

We claim:

1. A digital sound processor, for processing multiple standard sound signals which are applied as analog or digital signals from at least one signal source to the sound processor at baseband or higher frequencies, and from which separate output signals are formed for sound reproducers, comprising:

the digital sound processor having a control input coupled to at least one external control device which sends control signals to an internal control processor provided in the sound processor for controlling the operating mode of the sound processor, said operating mode being dependent on the respective sound standard;

wherein the control input is further coupled to an internal audio source which, by means of the control signals applied at the control input, generates further audio signals which are fed to the sound reproducers or to further sound reproducers.

2. The digital sound processor of claim 1, wherein the internal audio source retrieves the further audio signals from a memory device as a data sequence.

3. The digital sound processor of claim 2 wherein, the data rate of the data sequence in the internal audio source is temporally compressed or interpolated with respect to the data rate of the control signals applied at the control input.

4. The digital sound processor of claim 2 wherein, the data rate of the data sequence in the internal audio source is temporally compressed and interpolated with respect to the data rate of the control signals applied at the control input.

5. The digital sound processor of claim 1, wherein the internal audio source includes a synthesizer which assembles the further audio signals from stored signal components whose time sequence is fixed by a microprogram which is activated by the control signal applied at the control input.

6. The digital sound processor of claim 5, wherein the synthesizer is designed as a speech synthesizer.

7. The digital sound processor of claim 6, wherein the synthesizer is controlled by control signals assigned to alphanumeric characters which are contained as textual information in a color television signal or on a PC screen.

8. The digital sound processor of claim 1, wherein by the internal audio source cues or prompts are released in tonal or spoken or visual form.

9. The digital sound processor of claim 8, wherein the cues or prompts are selectable and replaceable.

10. The digital sound processor of claim 9, wherein the cues and prompts are released by interaction of the digital sound processor with a personal computer, the personal computer being coupled to the control input of the digital sound processor via an external control bus.

11. The digital sound processor of claim 1, wherein by the internal audio source, cues and prompts are released.

12. The digital sound processor of claim 11, wherein said cues and prompts are released in a form selected from the group consisting of: tonal, spoken and visual form.

13. The digital sound processor of claim 12, wherein the cues and prompts are replaceable.

14. A digital sound processor device comprising:

a plurality of signal sound processors and a corresponding plurality of signal sources, wherein each signal sound processor is respectively coupled to an associated one of said signal sources;

an internal control processor coupled to each of said plurality of signal sound processors for controlling the operating mode of said digital sound processor device;

a control bus coupling said internal control processor to external control means;

a matrix and mixer stage coupled between each of said plurality of signal sound processors and at least one output; and, an internal audio source coupled to said internal control processor and said matrix and mixer stage.

15. The device of claim 14, wherein said matrix and mixer stage can switch between and admix the output of said internal audio source and the output of each of said plurality of signal sound processors.

16. The device of claim 15, wherein the level of the output of each of said plurality of signal processors can be reduced by said internal control processor.

17. The device of claim 16, wherein the internal audio source generates an output on call.

18. The device of claim 17, further comprising a memory device.

19. The device of claim 18, wherein said call comprises an instruction word, which causes the internal control processor to access said memory device and generate said output.

20. The device of claim 14, wherein said external control means is selected from the group consisting of: a remote control receiver and a control device of a personal computer.

* * * * *